US012263917B2

(12) United States Patent
Newby et al.

(10) Patent No.: US 12,263,917 B2
(45) Date of Patent: Apr. 1, 2025

(54) PARACHUTE SEA ANCHOR

(71) Applicant: BAE SYSTEMS plc, London (GB)

(72) Inventors: Simon Phillip Newby, Barrow-in-Furness (GB); Jason Michael Dobb, Barrow-in-Furness (GB); David Charles Alexander Ritchie, Barrow-in-Furness (GB); Adam Benedict Bruce Cowley, Barrow-in-Furness (GB)

(73) Assignee: BAE SYSTEMS PLC, London (GB)

( * ) Notice: Subject to any disclaimer, the term of this patent is extended or adjusted under 35 U.S.C. 154(b) by 465 days.

(21) Appl. No.: 17/755,561

(22) PCT Filed: Nov. 2, 2020

(86) PCT No.: PCT/GB2020/052763

§ 371 (c)(1),
(2) Date: May 2, 2022

(87) PCT Pub. No.: WO2021/089989

PCT Pub. Date: May 14, 2021

(65) Prior Publication Data

US 2022/0266956 A1 Aug. 25, 2022

(30) Foreign Application Priority Data

Nov. 4, 2019 (GB) ..... 1915988

(51) Int. Cl.
*B63B 21/48* (2006.01)
*B63B 22/00* (2006.01)

(52) U.S. Cl.
CPC ..... *B63B 21/48* (2013.01); *B63B 22/003* (2013.01)

(58) Field of Classification Search
CPC ..... B63B 21/48; B63B 22/003; B63B 39/00; B63H 25/50
USPC ..... 114/311
See application file for complete search history.

(56) References Cited

U.S. PATENT DOCUMENTS 2,511,065 A 6/1950 Jackson
5,025,746 A 6/1991 Boulter
6,918,350 B1 * 7/2005 Morse ..... F03D 9/19 114/382

(Continued)

FOREIGN PATENT DOCUMENTS

DE 1028014 B 4/1958
DE 29901836 U1 5/1999

(Continued)

OTHER PUBLICATIONS

International Search Report and Written Opinion received for PCT/GB2020/052763. Mailed: Feb. 11, 2021. 14 pages.

(Continued)

*Primary Examiner* — Daniel V Venne
(74) *Attorney, Agent, or Firm* — Finch & Maloney PLLC

(57) ABSTRACT

This invention relates to a parachute sea anchor system deployable from a payload tube. There is provided a parachute sea anchor system suitable for launch from a vessel comprising at least one payload tube, said payload tube, comprising a payload canister, which comprises a parachute sea anchor, wherein said parachute sea anchor comprises a buoy tethered thereto, wherein said payload canister is attached to said vessel.

15 Claims, 2 Drawing Sheets

(56) References Cited

U.S. PATENT DOCUMENTS

| | | | | |
|---|---|---|---|---|
| 7,179,145 | B2 * | 2/2007 | Driscoll | B63B 21/48 114/294 |
| 7,228,812 | B2 * | 6/2007 | Morse | B63J 3/04 114/382 |
| 8,944,866 | B2 * | 2/2015 | Hine | B63G 8/42 440/9 |
| 2014/0007804 | A1 | 1/2014 | Gamache et al. | |

FOREIGN PATENT DOCUMENTS

| | | | |
|---|---|---|---|
| FR | 2339528 | A1 | 8/1977 |
| GB | 1527388 | | 10/1978 |
| GB | 2314532 | A | 1/1998 |
| WO | 2009144515 | A2 | 12/2009 |
| WO | 2021089989 | A1 | 5/2021 |

OTHER PUBLICATIONS

GB Search Report under Section 17(5) received for GB Application No. 1915988.8, dated Mar. 26, 2020. 3 pages.
International Preliminary Report on Patentablity received for PCT/GB2020/052763. Mailed: May 19, 2022. 9 pages.

* cited by examiner

PARACHUTE SEA ANCHOR

This invention relates to a parachute sea anchor system deployable from a payload tube, more specifically a submerged payload tube.

Parachute sea anchors are known devices that are used by a vessel. They may be used to reduce the drift of a vessel, or to keep the bow of a vessel head to wind.

According to a first aspect of the invention there is provided a parachute sea anchor system suitable for launch from a vessel, comprising at least one payload tube;

said payload tube comprising a payload canister, which comprises a parachute sea anchor, wherein said parachute sea anchor comprises a buoy tethered thereto, wherein said parachute sea anchor is attached to said vessel.

Preferably the payload tube is a submerged payload tube, which is a payload tube which is under a body of water, when the vessel is in normal operational use. It is located on a part of a vessel that is substantially always beneath the surface of the water.

According to a further aspect of the invention there is provided a parachute sea anchor system suitable for launch from a vessel, said vessel comprising at least one submerged payload tube under a body of water; said submerged payload tube, comprising a payload canister which comprises a parachute sea anchor, wherein said parachute sea anchor comprises a buoy, tethered thereto, wherein said parachute sea anchor is attached to said vessel.

The parachute sea anchor may be attached to the vessel via a severance device, the severance device may be affixed to a structural member, such as for example the payload tube or one of the vessel's internal structural members. Preferably the severance device is attached to part of the payload tube.

The payload tube may be a single use tube, such that there is no watertight barrier to load/retrieve the payload canister or severance device after deployment. In a highly preferred arrangement it is the submerged payload tube, and comprises at least one watertight barrier, located between said body of water and submerged payload tube.

The submerged payload tube may comprise at least two watertight barriers, a first watertight barrier located on the exterior of the vessel, and a second watertight barrier to allow access to the submerged payload tube from within the vessel. The use of a second water tight barrier allows the submerged payload tube to be used for a plurality of payloads, and at the required time, be capable of supporting the payload canister comprising said parachute sea anchor and buoy.

The barrier must be water tight to the pressures typically exerted on said vessel. The barrier may be a single use operation or resealable, so as to allow closure of the submerged payload tube. The watertight barrier may be, such as, for example a door, membrane or cover plate.

The submerged payload tube may be any delivery tube that is capable in use of ejecting a payload from a vessel, preferably via the watertight barrier.

Where the payload tube is located above sea level on the vessel, may only need to prevent water ingress under atmospheric pressure conditions. Therefore a barrier capable of withstanding high pressures may not be required, and simple covers or membranes may be sufficient to prevent ingress.

In use the parachute sea anchor may control the movement of the vessel to which it is tethered.

The vessel may such as, for example be a surface ship which may comprise a payload tube located on the hull, a surface ship with a submerged payload tube below the water line, a submersible vessel with a submerged payload tube below the water line, or even part of an offshore platform. The vessel may have one or more payload tubes, and may have at least one above sea level payload tube and/or at least one submerged payload tube. It will be clear that above and below the level of the sea, are terms which define the vessel in normal use, and is not to be restricted to moments in time where due to the nature of the sea, the vessel's payload tube location in the water may momentarily be changed.

The parachute sea anchor comprises an anchor tether, said anchor tether connecting the parachute sea anchor to the vessel. The anchor tether may be connected via a severance device, such that after use of the parachute sea anchor, the severance device may release the anchor tether and allow the parachute sea anchor and hence anchorage to be removed from the vessel. The severance device may be a cutter, blade, shear device or release device to cause the anchor tether to be cut.

The severance device may comprise a spool, the spool may further have a cutter to cut the anchor tether, or may pay out the entire length of the anchor tether to allow all of the anchor tether to exit the spool, and hence release the anchor tether and parachute sea anchor.

Preferably the anchor tether may be connected to the structural member, and passes through a severance device, such as a cutter, such that the anchor tether may be caused to be cut, to release the anchor tether, and hence release the parachute sea anchor from attachment to the vessel.

In an alternative arrangement there may be a retraction system, such as for example a spool or winder, so as to allow retraction of the anchor tether and hence to retract the parachute sea anchor back into the payload tube.

The parachute sea anchor may be any commercially available parachute sea anchor. The parachute sea anchor may be of any commonly used parachute shape.

The anchor tether may be a line, rode, chain, rope, or combination thereof. There may be significant forces exerted on the vessel and parachute sea anchor, and the use of resilient materials, such as a rode line may mitigate against large impulsive forces. The anchor tether may further comprise an electrical and/or optical conductor, to allow the transmission of power or activation commands to the payload canister, and optionally the release mechanism.

The parachute sea anchor may comprise a buoy tether to connect the parachute sea anchor to the buoy, the buoy and hence buoy tether acts upon the parachute, due to the buoyancy, and causes the parachute to maintain an optimum depth. The anchor tether may be caused to pass through the parachute sea anchor, and thereby also connect to the buoy.

The buoy may comprise a transponder and/or other communication devices to provide an alert to nearby vessels, or to request assistance.

The buoy tether may comprise an electrical and/or optical conductor located therein, which may allow communication, power to pass from the payload tube to the buoy, transponder or payload canister.

The payload canister may be ejected from the payload tube, said payload tube may be in a submerged state, below the water line.

In a submerged payload tube, the canister comprising the parachute sea anchor must be ejected clear of the payload tube before allowing the parachute sea anchor to deploy. The parachute sea anchor is housed in the payload canister to facilitate deployment of the parachute sea anchor from the submerged payload tube.

The payload canister may comprise a release mechanism to allow the parachute sea anchor and buoy to be deployed from said payload canister.

The payload canister may be manufactured from any suitable material, such as a metal, metal alloys, polymers, or composites.

The release mechanism on the payload canister may be passive or active. The active release mechanism may comprise a mechanical, electrical, or energetic device to cause rupture and/or separation of the payload canister, so as to allow the parachute sea anchor and buoy to be deployed from the canister. The release mechanism may be any means to cause the contents of the canister to be released into the water, such as for example an actuator, releasable connector, or cutter.

The payload canister may be unitary such that the release mechanism may be required to cut, tear, rupture said canister to release the contents therein.

The payload canister may comprise at least two portions, with a join therebetween, such as two main body sections, or a lid and elongate body. The at least two portions may be secured together by a releasable connector, optionally the releasable connector may be at the join. The releasable connector may use actuators, to allow the separation of the payload canister. Alternatively the canister may be ruptured, by a cutting mechanism to cause separation either at a releasable connector, or along one of or at least two the portions to cause the opening of the payload canister. The join may be created with a weakened portion, to allow for the facile separation of the at least two portions.

The use of energetic materials, such as pyrotechnic actuators or explosive cutting cords may also be used to provide rupturing or cause separation of releasable connectors on the payload canister.

The activation of the active release mechanism may be initiated by the initial launch sequence. The electrical power for electromechanical systems, may be primary, secondary or saltwater cells, alternatively capacitive storage may be used.

There may be electrical power provided by an electrical conductor located in the anchor tether. The cells/capacitors may be provided with electrical charge by the vessel's native power supply, before launch, or via an electrical conductor in the anchor tether. The activation of the release mechanism may be a time delay from launch, use of hydrostatic sensors, or presence of salinity to determine the activation, or via a command signal via an optical and/or electrical conductor in the anchor tether. The activation of the release mechanism occurs once the payload canister has been ejected clear of the vessel.

The release mechanism may alternatively be passive, and may comprise a water soluble fastening, or resistance fit connectors. The release mechanism on the payload canister may comprise a weakened region in order to facilitate separation.

In one arrangement the release mechanism, may comprise a resistance fit between at least two portions, which together form the payload canister, said anchor tether comprises a resilient rode line with a first state and second state, in a first state said anchor tether is in a non-extended state, in a second state the anchor tether is such it causes tension capable of overcoming said resistance fit between the at least two portions; to allow dispersal of said parachute sea anchor and buoy.

In this arrangement the canister is launched so as to cause sufficient extension of the rode, such that upon said rode returning to its non-extended state, has sufficient kinetic energy to overcome the resistance fit between the first and second portion.

The payload canister is deployed such that it has completely left the payload tube and is clear of the vessel, before the payload canister is caused to deploy the parachute sea anchor.

The payload canister may be ejected by any known means, such as for example a pressurised system within the vessel, or a propulsion system on the payload canister or a combination thereof. Preferably the canister may be ejected by on-board high pressure fluid systems. The payload canister typically only needs to be sent clear of the vessel, therefore in a preferred arrangement the payload canister may be ejected from the payload tube by a positive pressure of water from the vessel, such as for example pumps or rams. The working fluid may be any compressible gas or liquid, such as for example water, air, $CO_2$ or hydraulic.

Alternatively, once the watertight barrier is open, the canister may be allowed to flow out of the payload tube, without a positive pressure. However, care must be taken that the canister is clear of the vessel, before the release mechanism is activated, to deploy/inflate the parachute sea anchor. Where there is no active ejection by the vessel; the payload canister may have its own propulsion system for underwater deployment, such as for example, propellers, impellers, water jets, and may be powered by an electrical motor, energetic material or a combustion engine.

Where the ejection of the payload canister is of a low velocity, this type of ejection may require an active release mechanism to be used to ensure deployment of the parachute sea anchor.

According to a further aspect of the invention there is provided a method of preventing drift of a vessel, said vessel comprising at least one submerged payload tube under a body of water;

i) securing the system as herein defined, to a structural member of the vessel or payload tube, and locating the payload canister within said payload tube, ii) opening the watertight barrier, iii) causing a positive pressure of fluid, to eject the payload canister from the payload tube, iv) causing deployment of the parachute sea anchor from said payload canister.

v) optionally manoeuvring said vessel to allow said deployed parachute to open

Once the parachute sea anchor has provided its function, the system may comprise a severance device, so as to cause the severance of the parachute sea anchor from the vessel.

The step ii) of opening the watertight barrier may not be required where the watertight barrier may be a single use barrier, such as a cap or membrane that can be punctured during the ejection of the payload canister.

An arrangement of the invention will now be described by way of example and with reference to the accompanying drawings of which;—

FIG. 1*a* shows a parachute sea anchor system in a first state.

FIG. 1*b* shows a parachute sea anchor system in a second deployed state.

Figure 1A:
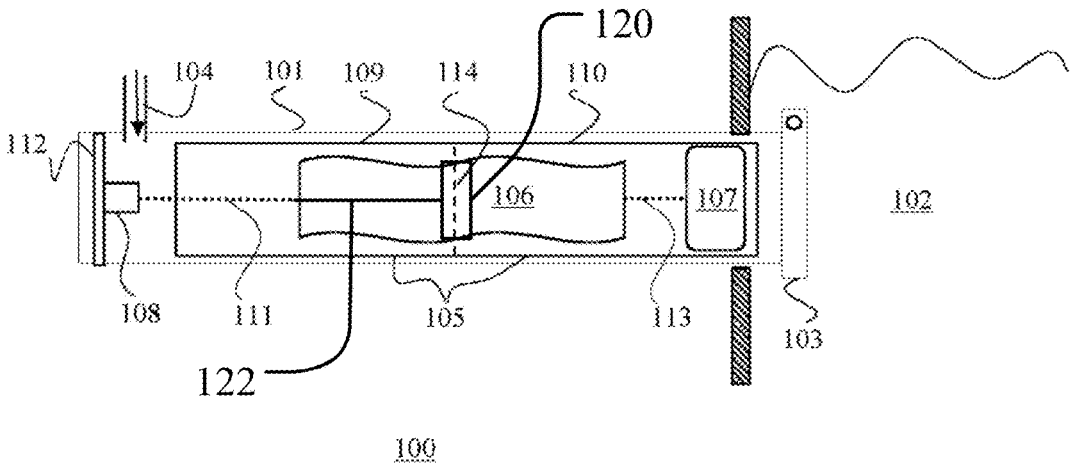

Turning to FIG. 1*a*, there is provided a parachute sea anchor system 100 in a first state, suitable for launch from a vessel (not shown) comprising at least one submerged payload tube 101 below the water line 102. The submerged payload tube 101 comprises at least one watertight barrier 103, to keep the water outside of the payload tube, a fluid ejection system 104 to provide a high pressure fluid to ejection the payload canister 105. The payload canister 105 comprises a parachute sea anchor 106, and a buoy 107 tethered thereto. The payload canister 105 is attached to said vessel, via a severance device 108.

In the present arrangement, said payload tube 101 and watertight barrier 103 are constructed from a suitable materials capable of withstanding differential pressure. The payload canister 105 comprises two portions 109 110 which together form an elongate cylinder that houses the parachute sea anchor 106 and buoy 107.

The parachute sea anchor 106 may be made from nylon and may be reinforced by nylon tape across the canopy of said parachute sea anchor.

To aid in the recovery of a stricken vessel the buoy 107 may comprise an emergency location beacon in the form of a transponder (not shown). This may alert others to the plight of the stricken vessel. The transponder will only activate on release of the parachute sea anchor and buoy into the water.

The parachute sea anchor comprises an anchor tether 111 typically in the form of a resilient rode connecting to a suitable anchorage point on the vessel, such as the severance device 108. In the present arrangement, the anchor rode is made of a resilient material. — The anchor tether 111 comprises a connection to the parachute sea anchor 106, and further must pass through or be detachably linked to at least one of the at least two portion 109 of the payload canister. It is desirable, that both portions 109, 110 become fully detached from the anchor tether, to avoid impeding the operation of the parachute sea anchor 106.

The severance device 108 may be attached to a structural member of the vessel or part of the payload tube 105. In the present arrangement, the severance device is in the form of a mechanical cutter, which had been affixed to a removable anchor point 112 within the payload tube 101. After the use of the parachute sea anchor 106, the severance device 108 is activated to release the rode 111 and hence the parachute sea anchor 106 from connection with the vessel.

The parachute sea anchor 106 also comprises a buoy tether 113, again typically in the form of a resilient rode to connect the parachute sea anchor 106 to the buoy 107. The buoy 107 ensures that the parachute sea anchor remains at the optimum position in the water 102.

The payload canister 105 is formed from two portions 109 110 which together form an elongate cylinder, and in this arrangement are caused to be separated by a release mechanism 114 to allow the parachute sea anchor 106 and buoy 107 to be deployed. In this arrangement the release mechanism is a resistance fit between parts of the two portions 109 110 of the payload canister 105. The release mechanism 114 can include an active release mechanism 120 having a mechanical, electrical, or energetic device to cause rupture and/or separation of the payload canister. The anchor tether 111 includes an electrical and/or optical conductor 122 to allow transmission of activation commands to the active release mechanism 120 of the payload canister.

In use the watertight barrier 103, in the form of a door, will be opened. The fluid ejection system 104, will be caused to function, ejecting the payload canister 105 clear of the payload tube and therefore vessel.

Figure 1B:
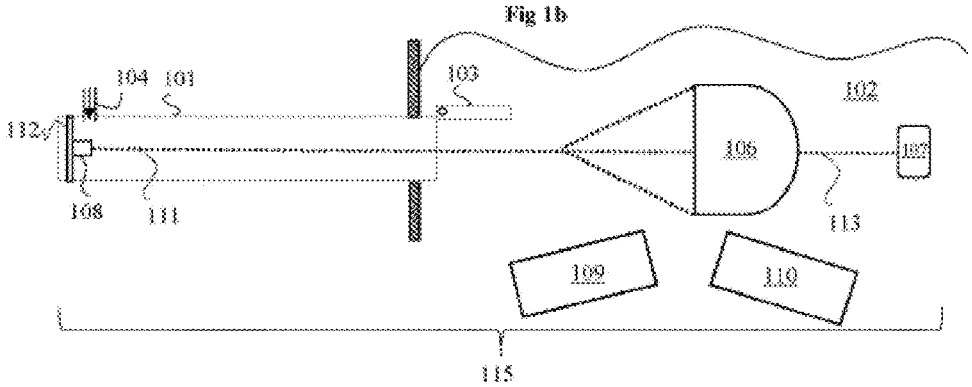

Turning to FIG. 1*b*, there is provided a parachute sea anchor system 115 in a deployed state. In this arrangement, the parachute sea anchor system 115 has ejected the payload canister 105 from the payload tube 101, through the water watertight barrier 103. The use of a positive pressure of fluid, in the form of a water ram 104, ensures the payload canister is ejected clear of the payload tube 101 and vessel.

In the present arrangement the release mechanism 114 is the resistance fit of portions 109 110 of the payload canister 105; which when overcome allows dispersal of said parachute sea anchor 106 and buoy 107. The force of the ejection from the payload tube and tensile force placed on portion 109, at the fully extension of the anchor tether will overcome the resistance fit. The parachute sea anchor 106 is inflated by the movement of the vessel such that the canopy inflates to provide a drag force on said vessel.

Once the parachute sea anchor system 115 has provided its useful function, the severance device 108 releases the anchor rode 111, parachute sea anchor 106, buoy tether 113 and buoy 107, allowing the water watertight barrier 103 to be closed.

Optionally, the payload tube 101 may be drained such that a second water watertight barrier (not shown) leading to the inside of a vessel may be opened to allow recovery of the removable anchor point 112.

Figure 2:
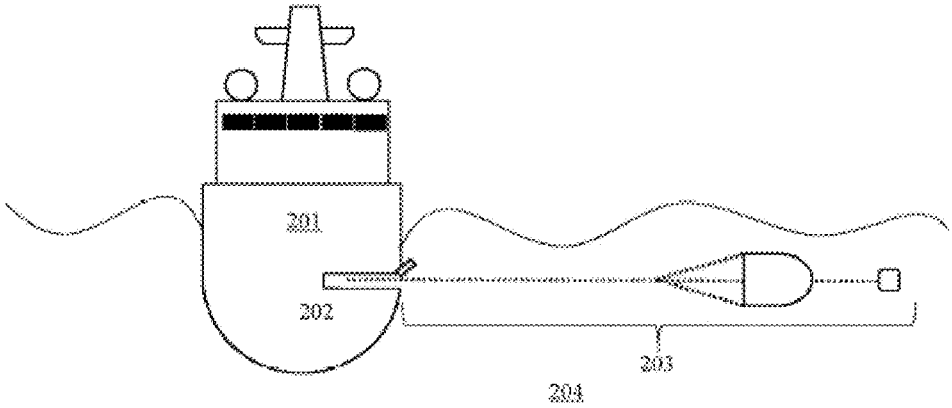
FIG. 2 shows a vessel with a parachute sea anchor systems deployed from a submerged payload tube.

Turning to FIG. 2, there is provided a stricken vessel 201 comprising an underwater payload tube 202 having deployed the parachute sea anchor system 203 of FIG. 1*a* & 1*b*, in an underwater environment 204.

Figure 3:
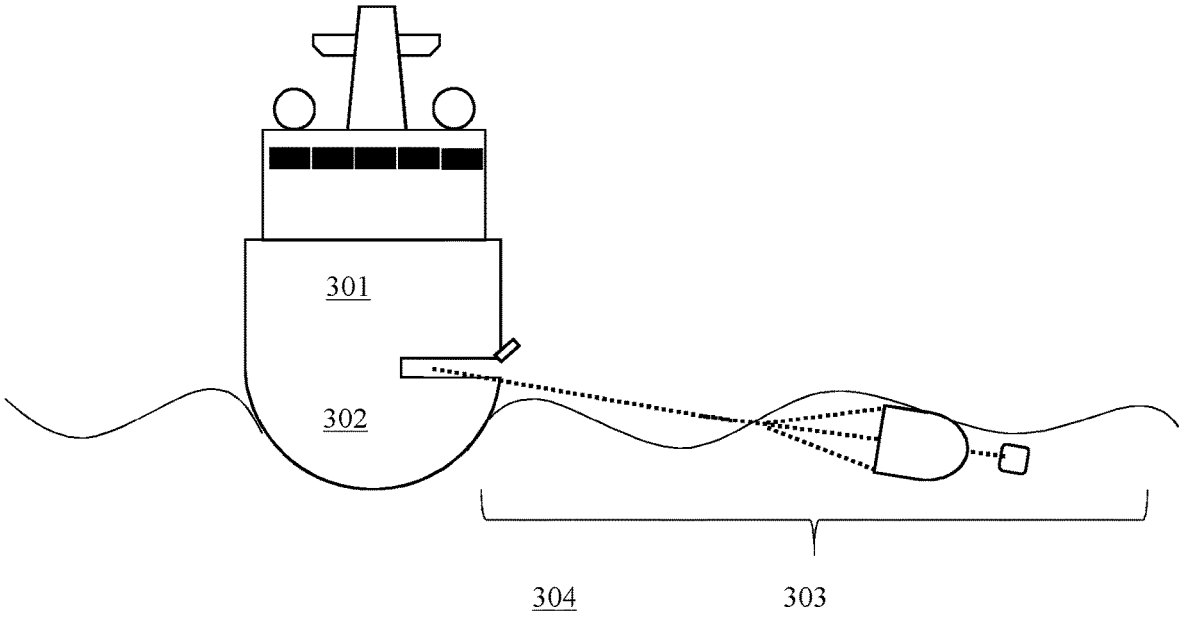
FIG. 3 shows a vessel with a parachute sea anchor systems deployed from a payload tube.

Turning to FIG. 3, there is provided a stricken vessel 301 comprising a payload tube 302 that is located substantially above the surface of the sea. The deployed the parachute sea anchor system 303, is launched from the above surface payload tube. The payload canister (not shown) may be caused to open in the same fashion as described earlier, when it enters the underwater environment 304.

The invention claimed is:

1. A parachute sea anchor system, the parachute sea anchor system being suitable for launch from a vessel, the parachute sea anchor system comprising at least one payload tube, said payload tube comprising a payload canister that includes a parachute sea anchor, wherein said parachute sea anchor comprises a buoy tethered thereto, wherein said parachute sea anchor comprises an anchor tether attached to said vessel, wherein the payload canister comprises an active release mechanism to allow the parachute sea anchor and the buoy to be deployed, the active release mechanism comprising a mechanical, explosive or electrical actuator to cause rupture and/or separation of the payload canister, and wherein the anchor tether comprises an electrical and/or optical conductor to allow transmission of activation commands to the active release mechanism of the payload canister.

2. The parachute sea anchor system according to claim 1, wherein the parachute sea anchor is affixed to the payload tube, or affixable to a structural member of the vessel.

3. The parachute sea anchor system according to claim 1, wherein the parachute sea anchor is attachable to the vessel via a severance device.

4. The parachute sea anchor system according to claim 1, wherein the parachute sea anchor comprises an anchor tether, said anchor tether connectable to said vessel.

5. The parachute sea anchor system according to claim 4, wherein the anchor tether is a rode, chain, line, or combination thereof.

6. The parachute sea anchor system according to claim 1, wherein the parachute sea anchor comprises a buoy tether, to connect the parachute sea anchor to the buoy, said buoy tether including an electrical and/or optical conductor.

7. The parachute sea anchor system according to claim 1, wherein the active release mechanism comprises a mechanical, explosive, or electrical actuator to cause rupture and/or separation of the payload canister.

8. The parachute sea anchor system according to claim 1, wherein the payload canister is ejectable from the payload tube by a positive pressure of fluid from the vessel.

9. The parachute sea anchor system according to claim 1, wherein the payload tube is configured to be a submerged payload tube under a body of water.

10. A method of preventing drift of a vessel, said vessel comprising at least one submerged payload tube under a body of water, the method including:

securing the parachute sea anchor system of claim 1 to a structural member of the vessel or payload tube, and locating the payload canister within said payload tube;

opening a watertight barrier to allow the payload tube to fill with water;

causing a positive pressure of fluid, to eject the payload canister from the payload tube; and causing deployment of the parachute sea anchor from said payload canister.

11. The parachute sea anchor system according to claim 3, wherein the severance device is configured to cut and release the anchor tether, and hence release the parachute sea anchor from attachment to the vessel.

12. The parachute sea anchor system according to claim 11, wherein the severance device includes a cutter, blade, or shear device to cause the anchor tether to be cut.

13. The parachute sea anchor system according to claim 11, including a retraction system having a spool or winder, so as to allow retraction of the parachute sea anchor back into the payload tube.

14. The parachute sea anchor system according to claim 11, in which said anchor tether is also connected to the buoy, thereby tethering the buoy and parachute sea anchor together.

15. The parachute sea anchor system of claim 1, wherein the active release mechanism is configured to be activated responsive to the activation command transmitted via the electrical and/or optical conductor.

* * * * *